US009345945B2

(12) United States Patent
Mudgett

(10) Patent No.: US 9,345,945 B2
(45) Date of Patent: May 24, 2016

(54) ADAPTABLE TRAINING PUTTER HEAD

(71) Applicant: F. Scott Mudgett, Del Mar, CA (US)

(72) Inventor: F. Scott Mudgett, Del Mar, CA (US)

( * ) Notice: Subject to any disclaimer, the term of this patent is extended or adjusted under 35 U.S.C. 154(b) by 0 days.

(21) Appl. No.: 14/575,957

(22) Filed: Dec. 18, 2014

(65) Prior Publication Data

US 2015/0105174 A1 Apr. 16, 2015

Related U.S. Application Data

(63) Continuation-in-part of application No. 14/249,311, filed on Apr. 9, 2014, now Pat. No. 9,149,706.

(60) Provisional application No. 61/811,093, filed on Apr. 11, 2013.

(51) Int. Cl.

| | |
|---|---|
| ***A63B 69/36*** | (2006.01) |
| ***A63B 53/06*** | (2015.01) |
| *A63B 53/02* | (2015.01) |
| *A63B 53/04* | (2015.01) |

(52) U.S. Cl.

CPC ..... *A63B 69/3685* (2013.01); *A63B 53/0487* (2013.01); *A63B 53/065* (2013.01); *A63B 53/02* (2013.01); *A63B 2053/0491* (2013.01); *A63B 2210/50* (2013.01)

(58) Field of Classification Search

CPC .. A63B 53/065; A63B 53/0487; A63B 53/02; A63B 2210/50; A63B 69/3685; A63B 2053/0491

USPC ..... 473/236, 238, 341

See application file for complete search history.

(56) References Cited

U.S. PATENT DOCUMENTS

| | | | | | |
|---|---|---|---|---|---|
| 5,137,275 | A * | 8/1992 | Nelson | A63B 53/02 | 473/306 |
| 6,699,140 | B1 * | 3/2004 | Sun | A63B 53/0487 | 473/252 |
| 7,614,960 | B2 * | 11/2009 | Miller | A63B 53/0487 | 473/236 |
| 9,149,706 | B2 * | 10/2015 | Mudgett | A63B 69/3685 | |
| 2006/0223649 | A1 * | 10/2006 | Rife | A63B 53/0487 | 473/334 |
| 2007/0129163 | A1 * | 6/2007 | Solari | A63B 53/0487 | 473/336 |

* cited by examiner

*Primary Examiner* — Sebastiano Passaniti

(74) *Attorney, Agent, or Firm* — IDP Patent Services; Olav M. Underdal

(57) ABSTRACT

An adaptable training putter head for use in a training putter includes a conventional style putting head, further including a cavity, an outer cutout, and an inner cutout; an alignment guide piece, further including an outer alignment guide, an inner alignment guide, and a center insert bridge piece; all mounted to the conventional style putting head, to which is also attached a hosel connector. The alignment guides can be hollow, can each include an upper and a lower body, and can include alignment guide cavities, which can contain alignment guide weights for adjusting weight and balance. The adaptable training putter head allows a golf player to visually ensure that a putting club is oriented correctly during a putting swing, to improve accuracy during golfing. The adaptable training putter head supports both regulation conformant and non-conformant configurations.

11 Claims, 12 Drawing Sheets

ADAPTABLE TRAINING PUTTER HEAD

CROSS-REFERENCE TO RELATED APPLICATIONS

This application is a Continuation-In-Part of U.S. Non-Provisional application Ser. No. 14/249,311, filed Apr. 9, 2014, which claims the benefit of U.S. Provisional Application No. 61/811,093, filed Apr. 11, 2013, which are both included by reference herein in their entirety.

FIELD OF THE INVENTION

The present invention relates generally to the game of golf, and more particularly to the putting aspect of the game, and a special construction of the putting head of a golf putter, for the purpose of aiding the average recreational player in practice, training and normal game play.

BACKGROUND OF THE INVENTION

Many attempts have been made to improve golf putter design in order to increase accuracy and reliability during the putting phase of the game.

Various regulations, such as the Official United States Golf Association (USGA) Rules of Golf, limit the putter head designs for clubs to be used in officially sanctioned tournaments, handicapping and in other competitive game play.

This invention is not designed with a primary goal of conforming to such regulations. Several aspects of its configuration and use may not conform to regulations, while other aspects allow for operation in a mode with detached elements, so that the putting head attains conformance with applicable regulations.

Rather, the aim of the present invention is to create a new type of putter that will help golf players of average ability to improve their performance and personal enjoyment of golf, during both practice sessions and normal game play.

More specifically, this invention helps the player target putter alignment throughout the entire putting stroke, employing a design construction with such necessary strength and stability so that it can equally well be employed as a training putter on the practice putting green or during practice rounds on a golf course, or be used as a conventional putter during tournament play.

As such, considering the foregoing, it may be appreciated that there continues to be a need for novel and improved devices and methods for improving putting reliability and accuracy.

SUMMARY OF THE INVENTION

The foregoing needs are met, to a great extent, by the present invention, wherein in aspects of this invention, enhancements are provided to the existing model of putting head design.

In aspects of this invention, a training putter can function as a new form of golf putter, which implements significant improvements for recreational and competitive golf play.

Firstly, the adaptable training putter head specifically disregards USGA putter regulations against having alignment features projecting forward of (and above) the clubface. The very reason that these features are disallowed for regulation golf is the same reason that they make putting with this training putter more fun—the forward projecting alignment guides make it much easier to direct the ball exactly where to go.

Secondly, in contrast to putting training aids designed for use solely on the putting green, the playability of the training putter's hybrid design, with conforming and non-conforming features, invites recreational golfers to 'train' or practice while playing on the course.

Thirdly, the adaptability of the training putter's features enable a golfer to not only polish and solidify his/her putting stroke, but also allow the golfer to easily convert the training putter to a regulation conform club for tournament golf.

In related aspects, the adaptable training putter head respects the fact that most golfers do not play golf strictly conforming to the USGA Rules of golf. By making the sinking of longer putts so very much easier, the adaptable training putter head makes recreational golf much more fun and rewarding, while improving the putting stroke overall.

In one aspect, this invention includes one or more of three semi-permanently attached visual aids, mounted on a conventional blade style putter head. These visual aids are held in place by fasteners, such as screws, and are thus removable, allowing for adaptable configuration of the putting head.

In a related aspect, the visual aids can include the following:

a) A top-mounted sighting bar, protruding up from the club head, which indicates the proper position and angulation of the putter head when making contact with the golf ball during the putting swing motion. The Official Rules of Golf prohibit a visual aid extending upward from the club head, and this sighting bar may therefore not be regulation conformant; and b) Two alignment guides, mounted on the toe and heel of the putter head, extending forward (and rearward) of the clubface. They are both mounted with a fastener, such as a simple screw. This allows them to be easily positioned in the reverse direction, reducing the amount of aid the guides provide. The Official Rules of Golf prohibit any visual aid extending forward of the club face, and these alignment guides may therefore not be regulation conformant.

In a related aspect, the sighting bar and the alignment guides can be easily removed, thereby converting the putter into a conventional style putter.

In a related aspect, the sighting bar can help a golf player position the putter head correctly behind the golf ball when the golf player is addressing the putt and before the putting stroke is executed. The sighting bar can also allow the player to visually confirm the direction of the intended put.

In a related aspect, the alignment guides can allow the player to visually ensure that the golf putter head is oriented correctly, by enabling the golfer to draw a mental image of two straight tracks that the alignment guides should follow during the entire evolution of a putting stroke along the intended putting line.

In another aspect, a golf putter training clip-on device can include:

a) Two alignment guides;

b) A bridge, such that the alignment guides connect on either end of the bridge, and are perpendicular to the bridge;

c) An elongator; which is perpendicularly connected to the bridge, such that the elongator is pointed upwards from the bridge;

d) A clip;

Such that the clip-on device can be attached to a putter by being clipped on to the hosel of the putter; where the elongator can allow for adjustment of the position of the clip-on device in relation to the head and hosel of the putter.

In yet another aspect, an adaptable training putter head for use in a training putter can include:

a) a putting head, further including:
   i. a cavity; such that the cavity is open in a rear of the putting head;
   ii. an outer cutout; and
   iii. an inner cutout;

b) an outer alignment guide, secured with a fastening mechanism to the outer cutout of the putting head, such that a direction of the outer alignment guide is in a putting target direction, perpendicular to a face of the putting head;

c) an inner alignment guide, attached with a fastening mechanism, to the inner cutout of the putting head, such that the inner alignment guide is mounted closer to the player, such that a direction of the inner alignment guide is in the putting target direction, perpendicular to the face of the putting head;

whereby a golf player can adjust proper putter alignment throughout an entire putting stroke, by ensuring that the inner and outer alignment guides are pointed in the intended putting target direction.

In a related aspect, the adaptable training putter head can further include:

a) an alignment guide piece, further including:
   i. the outer alignment guide;
   ii. the inner alignment guide;
   iii. a center insert bridge piece, which is connected between the outer and inner alignment guides, such that a front part of the center insert bridge piece fits inside the cavity;

wherein a weight of the center insert bridge piece, positioned inside the cavity, provides a counter balance weight, to a weight of the outer and inner rear pointing alignment guides.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
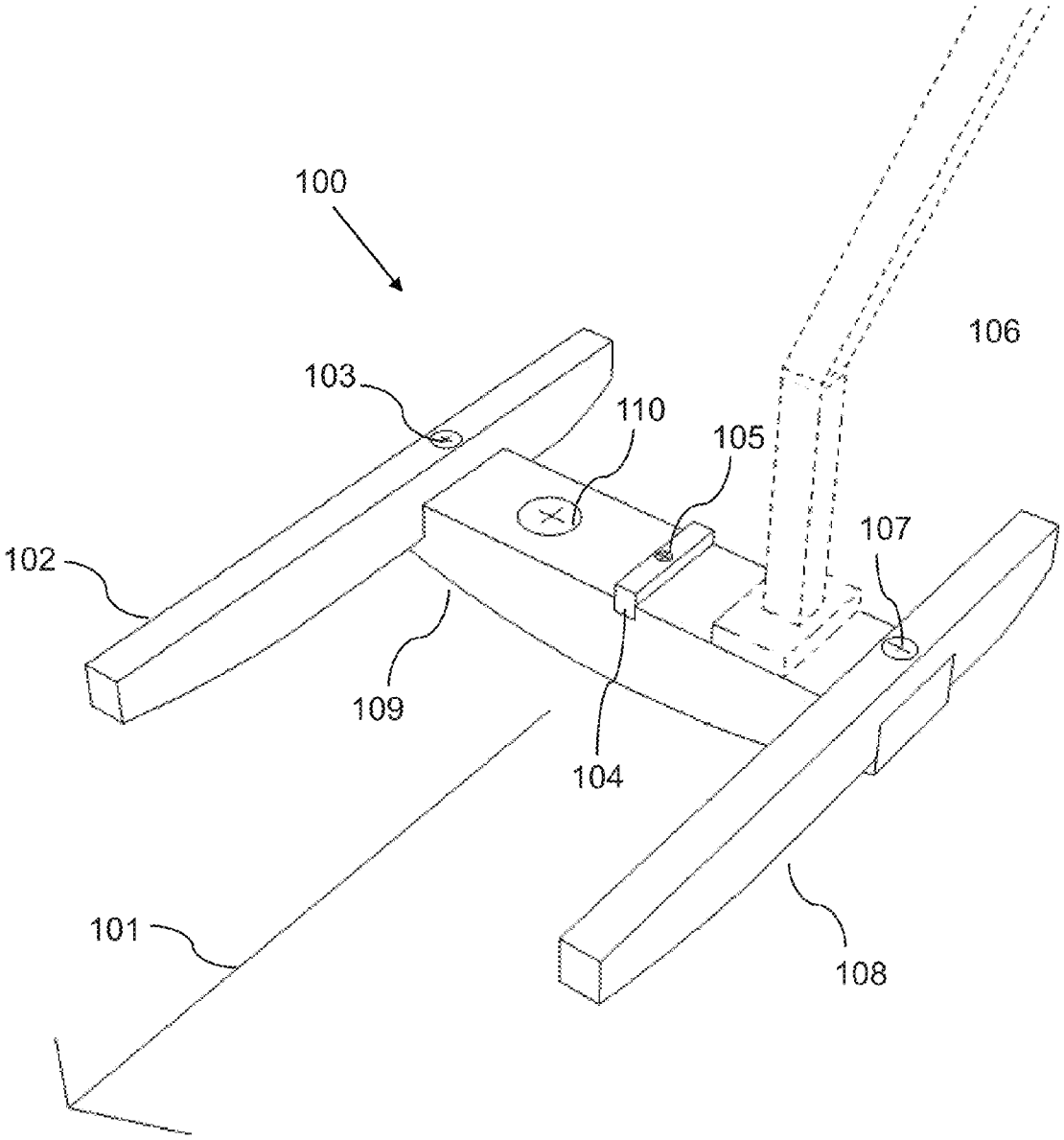
FIG. 1 depicts a top perspective view of an embodiment of the adaptable training putter head.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

One embodiment of the adaptable training putter head describes a standard golf putter head, attached via a hosel, to a standard golf putter shaft, whereby this standard golf putter head is adapted to be mounted with a plurality of alignment devices.

In the following, the toe shall denote the far or outer end of the club head, in relation to the player, and correspondingly the heel shall denote the inner end, which is closest to the player. The face of the club head shall denote the part of the club head, which comes into direct contact with the golf ball, during a forward motion golf swing.

In the following, we describe the structure of an embodiment of the adaptable training putter head in reference to FIG. 1, in such manner that like reference numerals refer to like components throughout; a convention that we shall employ for the remainder of this specification.

An adaptable training putter head 100 can include:

a) a standard putting head 109;

b) an outer alignment guide 102, secured with a fastening mechanism 103, such as for example a screw; to the standard putting head 109; to which is further attached c) a sighting bar 104, secured with a fastening mechanism 105;

d) a hosel 106, attached with a bottom mounted fastening mechanism 201 (FIG. 2); and e) an inner alignment guide 108, attached with fastening mechanism 107, such as for example a screw; to the standard putting head 109, such that the inner alignment guide is mounted closer to the player;

whereby a golf player can adjust proper putter alignment throughout an entire putting stroke, by ensuring that the toe and heel mounted alignment guides 102, 108 are pointed in the intended putting target direction; and the sighting bar 104 can help a golf player position the putter head correctly behind the golf ball and further allow the golf player to visually confirm the direction of the intended putt, when the golf player is addressing the putt and before the putting stroke is executed.

In a related embodiment, the outer alignment guide 102 can be toe mounted, such that the outer alignment guide 102 is mounted at the toe or substantially close to the toe of the standard putting head 109, such as illustrated in FIGS. 1-5.

In a related embodiment, the inner alignment guide 108 can be heel mounted, such that the inner alignment guide 108 is mounted at the heel or substantially close to the heel of the standard putting head 109, such as illustrated in FIGS. 1-5.

In various related embodiments, the alignment guides 102 108 can be mounted in a plurality of configurations, including:

a. The alignment guides 102 108 have a longer forward projection to the front of the standard putting head 109, and a shorter projection to the rear of the standard putting head 109, such as shown in FIGS. 1-5;

b. The alignment guides 102 108 have a similar length forward projection to the front of the standard putting head 109, as to the rear of the standard putting head 109;

c. The alignment guides 102 108 have a shorter forward projection to the front of the standard putting head 109, and a longer projection to the rear of the standard putting head 109;

d. The alignment guides 102 108 have only a forward projection to the front of the standard putting head 109;

e. The alignment guides 102 108 have only a projection to the rear of the standard putting head 109.

In a further related embodiment, a forward projecting part of each of the alignment guides 102 108 can be detachable, such that after removal of the forward projecting parts, the alignment guides 102 108 have only a projection to the rear of the standard putting head 109.

In a further related embodiment, a rearward projecting part of each of the alignment guides 102 108 can be detachable, such that after removal of the rearward projecting parts, the alignment guides 102 108 have only a projection to the front of the standard putting head 109.

In related embodiments, the standard putting head 109 can include a plurality of well-known traditional putting head design, including blade style, mallet style, and oversized style, as well as other types of putting heads. This can further include a plurality of shapes, grove designs, and weight distributions of the standard putting head 109.

FIG. 1 shows an adaptable training putter head in a right-handed configuration, with the direction of a normal putting target direction indicated by a directional arrow 101.

A further embodiment can include an alternative fastening aperture 110 for mounting the hosel 106 in a left-handed configuration.

Figure 2:
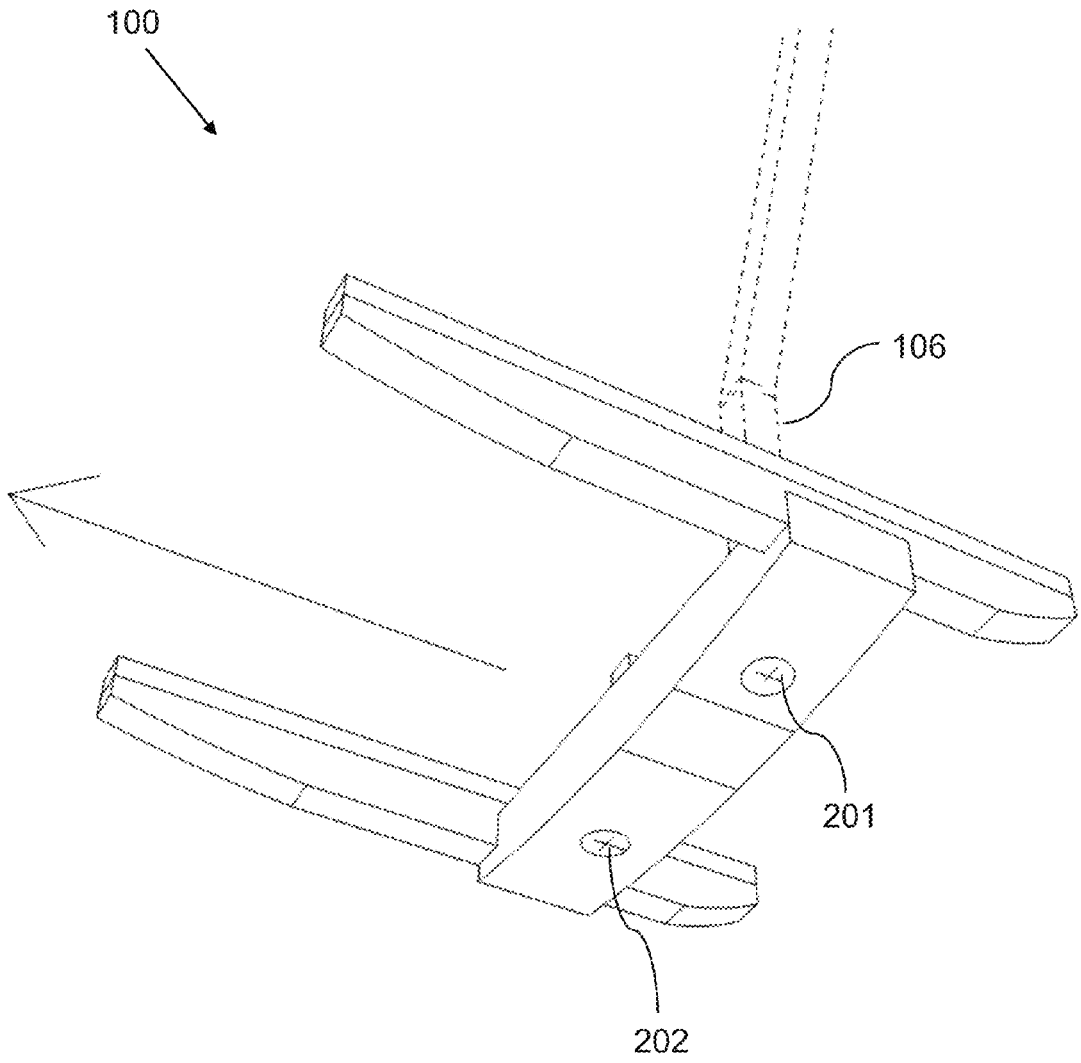
FIG. 2 depicts a bottom perspective view of an embodiment of the adaptable training putter head.

FIG. 2 shows a bottom-perspective view of an embodiment, indicating the fastening mechanism 201 for the hosel 106, in a configuration for right-handed play, and the alternative fastening aperture 202, for use in a configuration for left-handed play.

Further embodiments can include a plurality of alternative fastening mechanisms 103, 105, 107, 201, 202, which for example can include a screw, a bolt, a hand operated bolt, or a snap lock fastener.

Figure 3:
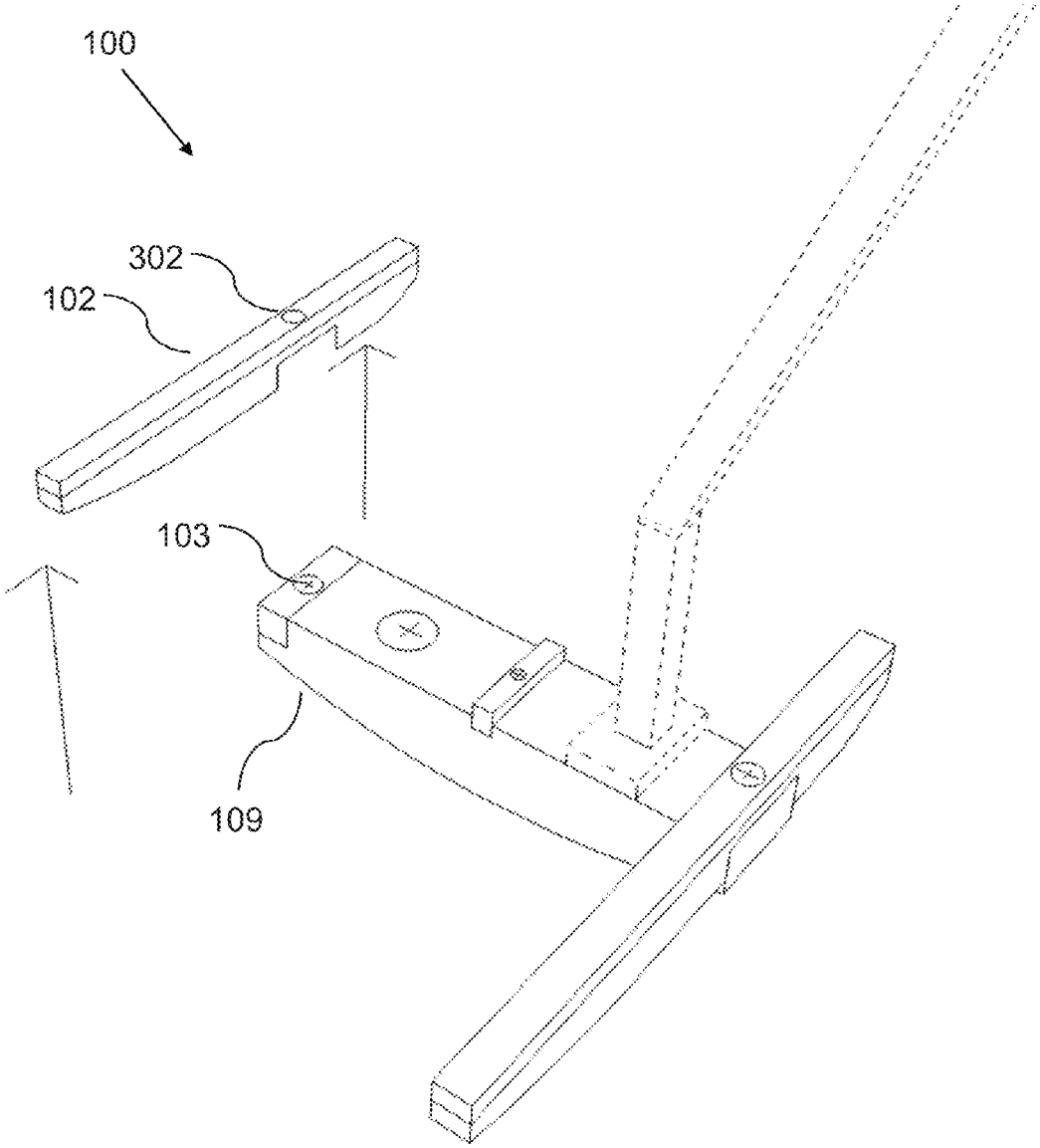
FIG. 3 depicts a top perspective view of an embodiment of the adaptable training putter head with the toe mounted alignment bar detached.

FIG. 3 shows an embodiment of the adaptable training putter head where the toe mounted alignment guide 102 can be detached from the standard putting head 109. For this usage, the fastening mechanism can be retained in position on the standard putting head 109. The alignment guide 102 is here shown with a screw hole 302.

Figure 4:
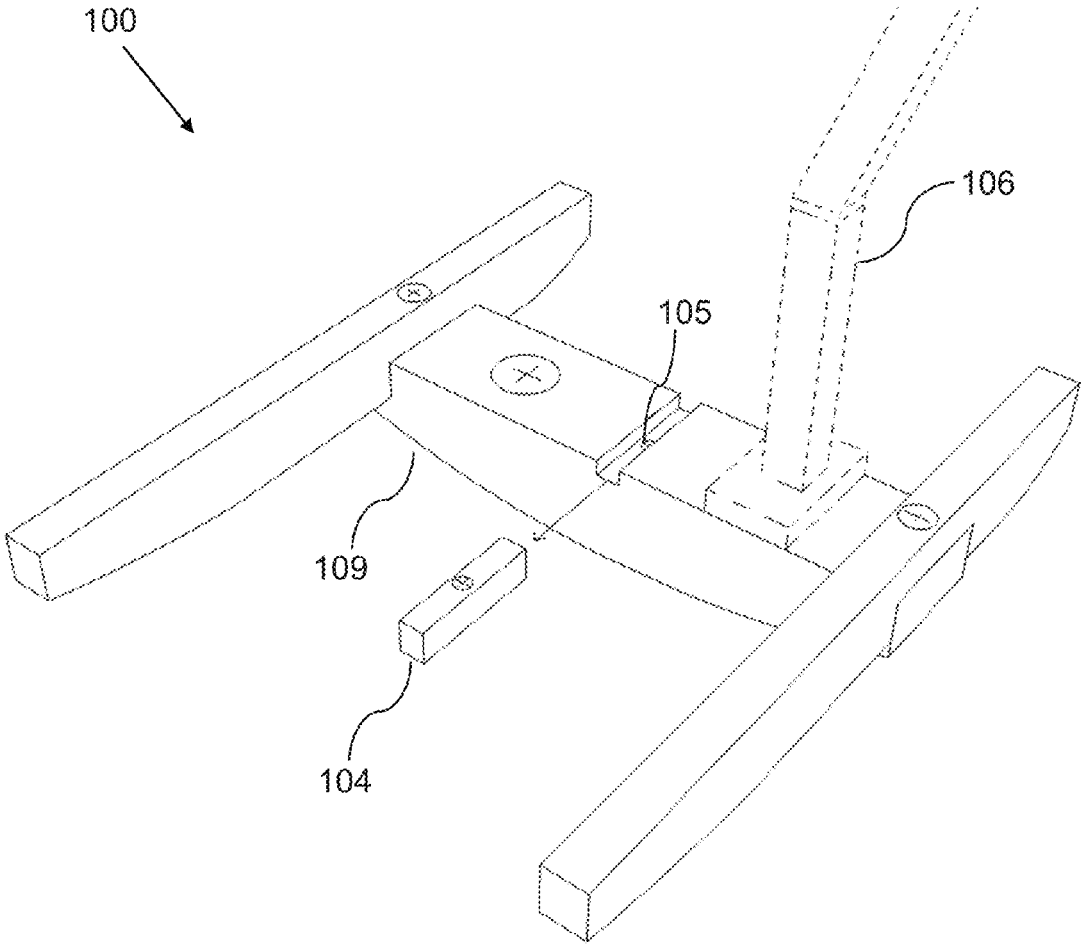
FIG. 4 depicts a top perspective view of an embodiment of the adaptable training putter head with the sighting bar detached.

FIG. 4 shows an embodiment of the adaptable training putter head in which the sighting bar 104 can be detached from the standard putting head 109, with its fastening mechanism 105 retained in the standard putting head 109.

Figure 5:
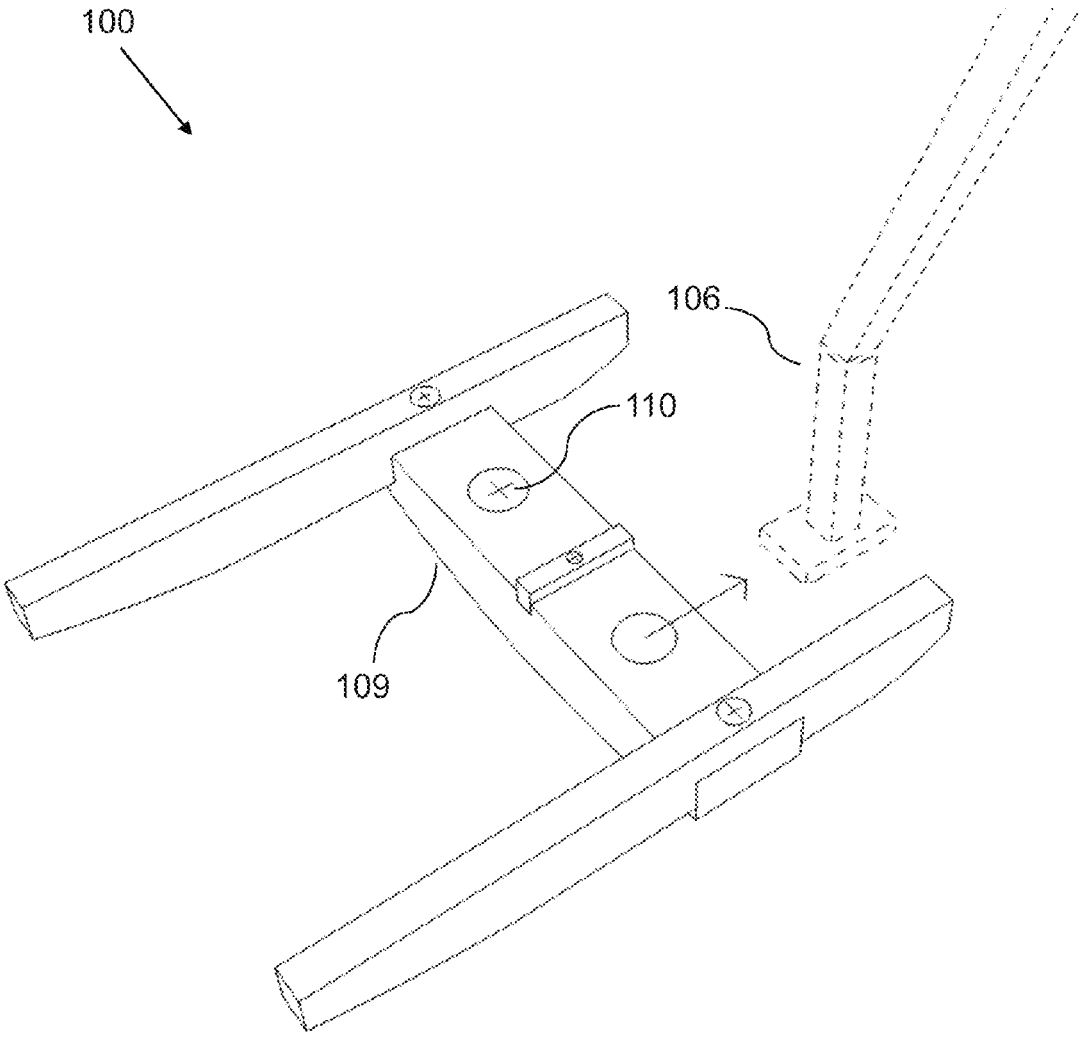
FIG. 5 depicts a top perspective view of an embodiment of the adaptable training putter head with the hosel detached.

FIG. 5 shows an embodiment of the adaptable training putter head 100 in which the hosel 106 can be detached, via release of fastener 201 (FIG. 2), from the standard putting head 109 in order to be repositioned for left-hand use configuration on the opposite side of the putter head at the position of the alternative fastening aperture 110, and fastened with fastener 202 (FIG. 2), or alternatively with fastener 201 (FIG. 2) relocated to the position of fastener 202 (FIG. 2).

Figure 6:
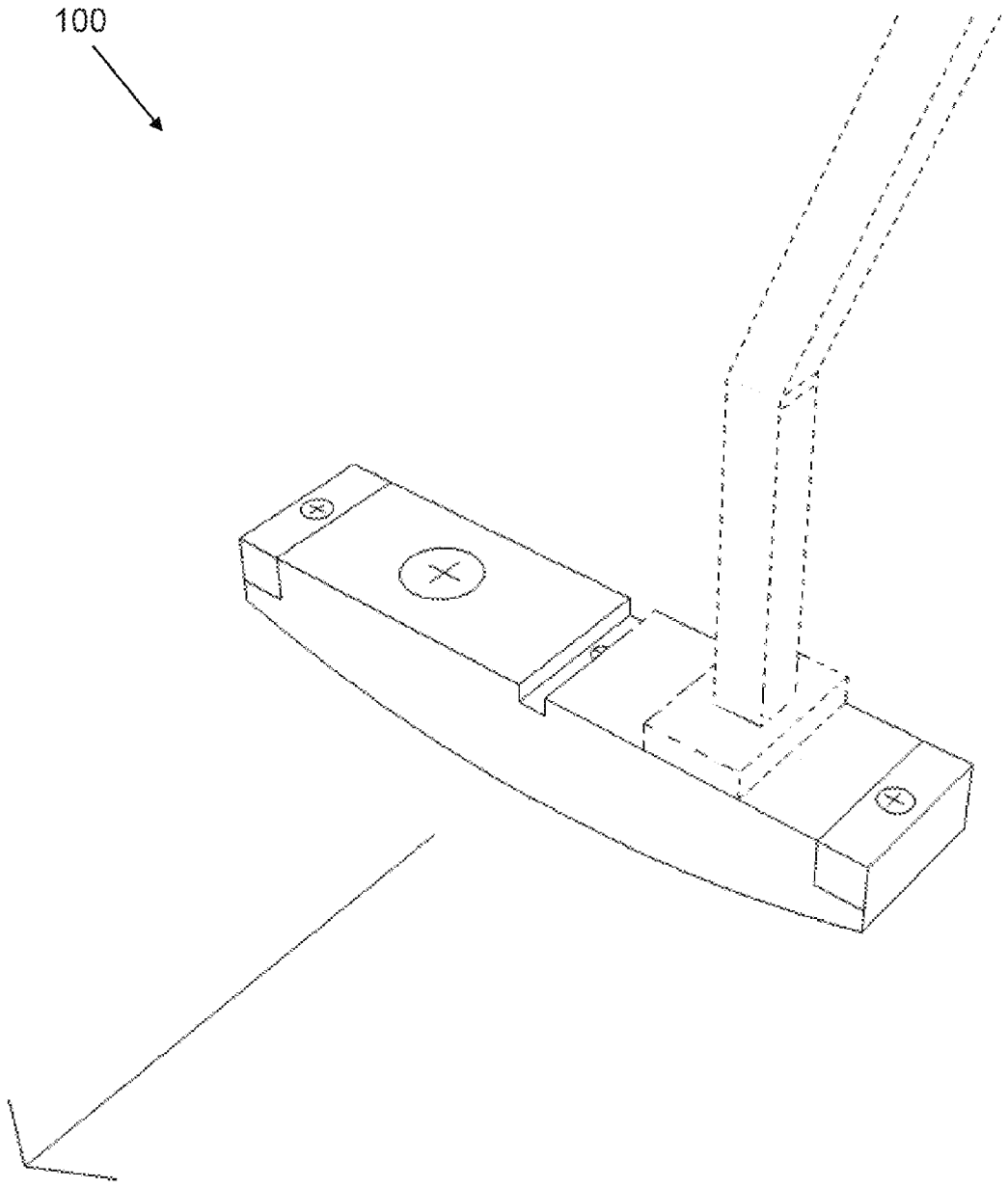
FIG. 6 depicts a top perspective view of an embodiment of the adaptable training putter head with the alignment bars and sighting bar detached.

FIG. 6 shows an embodiment of the adaptable training putter head 100, in a configuration with alignment guides and sighting bar detached, so that the adaptable training putter head 100 can be configured to be regulation conformant.

In various embodiments, the adaptable training putter head 100 can include one toe mounted alignment guide 102, or one heel mounted alignment guide 108, or one sighting bar 104, or any combination of these elements.

In a related embodiment, the adaptable training putter head 100 can include only one outer alignment guide 102, such that the outer alignment guide 102 is center mounted, such that the alignment guide 102, is mounted in the center, or substantially close to the center of the standard putting head 109, and further configured such that it does not interfere with a golf ball during a putting stroke.

In an embodiment, the standard putting head 109 can be made of a solid or machined hard durable material, such as for example a metal alloy. The toe and heel alignment guides 102 108 and the sighting bar 104 can be made of the same material, or a material with similar characteristics.

In a related embodiment, the standard putting head 109 can be made of a steel alloy, and inner and outer alignment guides 102 108 and the sighting bar 104 can be made of an aluminum alloy.

In a further related embodiment, the alignment guides 102 108 can be fully or partially hollow, in order to reduce weight and balance the club.

In a yet further related embodiment, the standard putting head 109 can be hollow, in order to reduce weight and balance the club.

Figure 9:
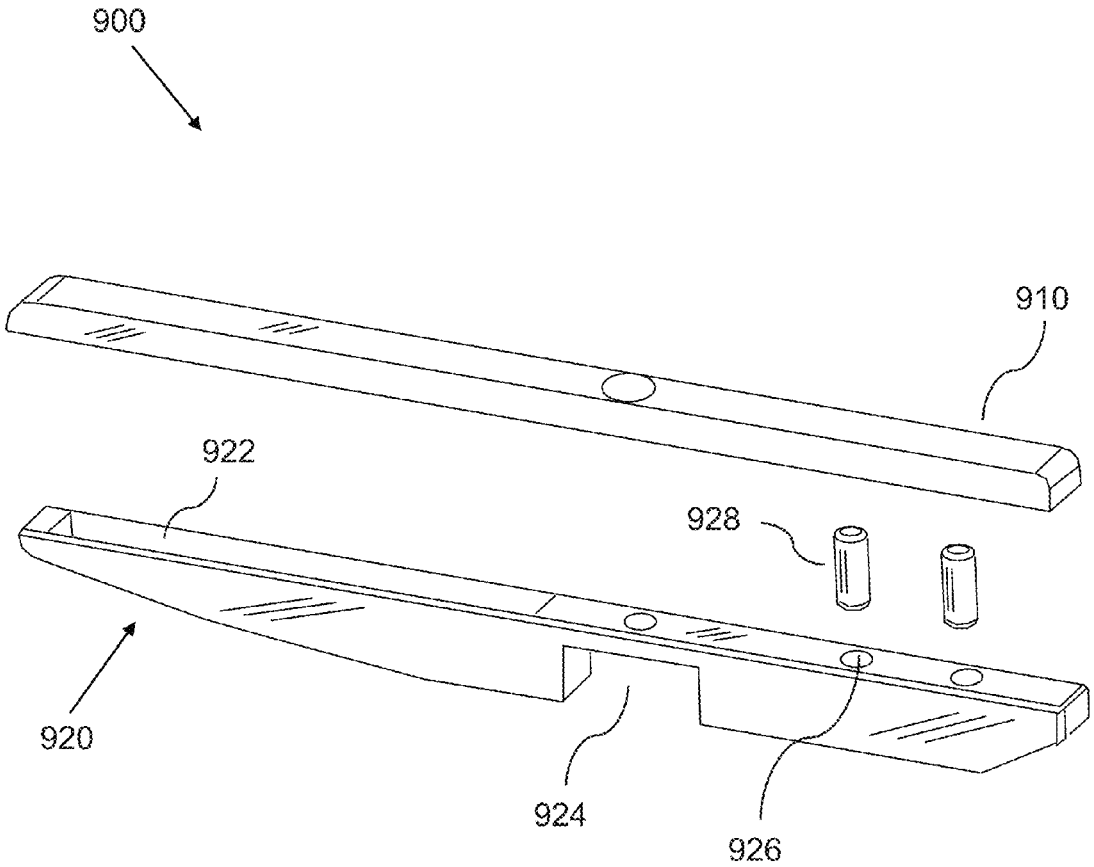
FIG. 9 depicts perspective view of an alignment guide, according to an embodiment of the invention.

In an embodiment, illustrated in FIG. 9, an alignment guide 900, such as an inner or outer alignment guide 102 108, can comprise of:

a. An upper body 910;

b. A lower body 920, such that the top of the lower body 920 can be covered by the upper body 910, wherein the lower body 920, can further comprise:

i. an alignment guide cavity 922, which partially hollows the lower body 920, and can be positioned in the front part of the lower body 920;

ii. an alignment guide cutout 924, which forms a shape to fit around the upper part of a standard putting head 109;

iii. at least one weight cavity 926;

iv. at least one alignment guide weight 928, which can be inserted in the weight cavity 926 in order to configure the balance of the adaptable training putter head 100.

In a further embodiment, the top half, a part of, or the entirety of the alignment guides 102 108, and the entire sighting bar 104 can be made of the same or similar material, but manufactured in a visually contrasting manner, such as for example with a dissimilarly colored but durable metal alloy, or by a coating with a bright and contrasting color.

In a further embodiment, the alignment guides 102 108 may be bottom mounted, to be either flush with or underneath the underside of the standard putting head 109. The alignment guides are shown top mounted in FIGS. 1-5.

In a further embodiment, the alignment guides 102 108 may be side mounted, mounted to the heel or toe side surface of the standard putting head 109.

In a further embodiment, the alignment guides 102 108 may be reverse mounted, so that the majority or the entirety of the alignment guides protrude in the backward direction, as compared to the direction of a putting stroke motion, from the standard putting head 109. The alignment guides are shown protruding in majority in the forward direction on FIGS. 1-5.

In related embodiments, the alignment guides 102 108 can be designed to weigh the same whether the long end is facing forward or the short end is facing forward, such that the screw hole 302 is the center of the forward/backward balance of the alignment guides 102 108.

In a related embodiment, the fastening mechanisms 103 107 for the alignment guides 102 108 can allow for these guides to be secured at varying distances from the center of the standard putting head 109 face, so that at closer distances there is less clearance room beside the golf ball, and correlated with this less club face surface area to allow for deviation from the perfect line, whereby the tighter spacing forces the golfer to develop a higher degree of control during the putting stroke.

Figure 7:
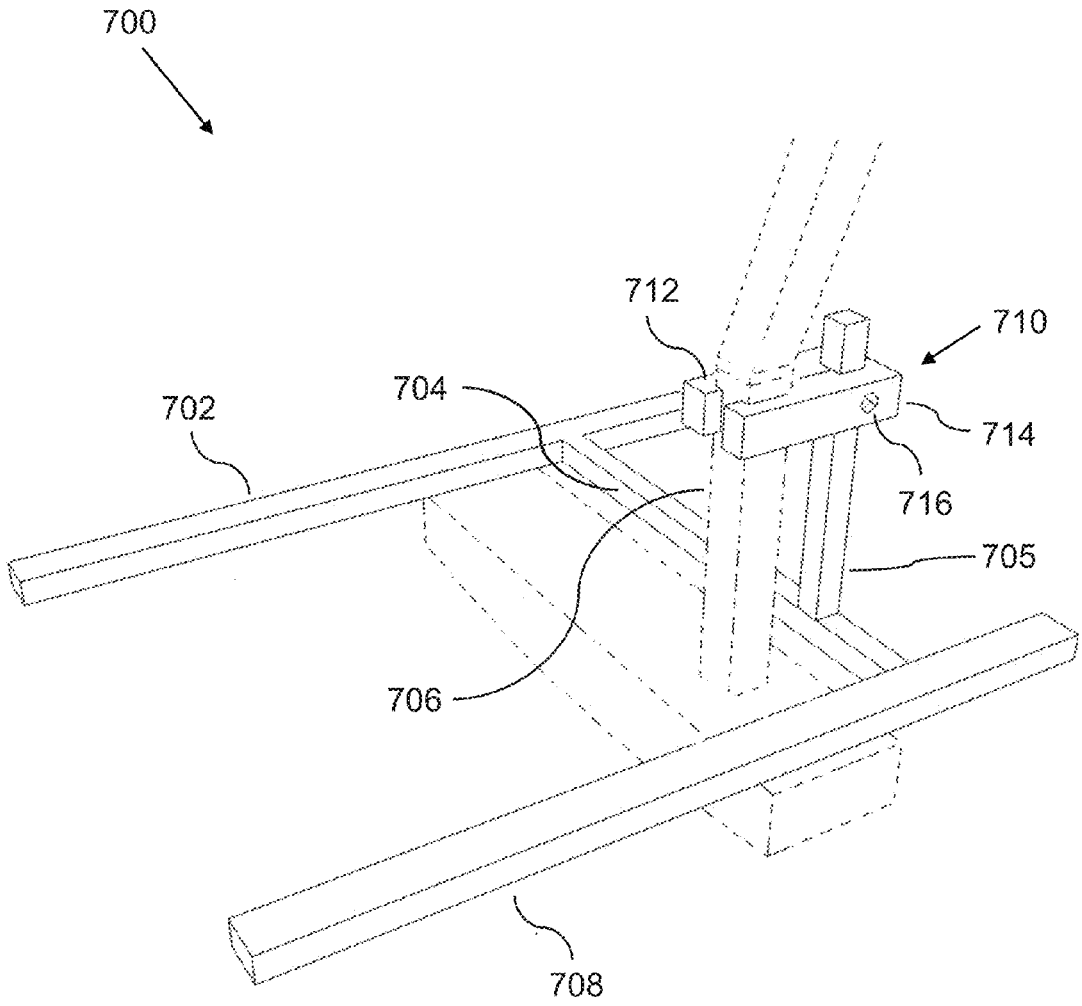
FIG. 7 depicts a perspective view of a golf putter training clip-on device with elongator, according to an embodiment of the invention.

In an embodiment, a golf putter training clip-on device 700, as illustrated in FIG. 7, can comprise:

a) An outer alignment guide 702;

b) An inner alignment guide 708;

c) A bridge 704; wherein i. the outer alignment guide 702 is connected to the outer end of the bridge 704;

ii. the inner alignment guide 702 is connected to the inner end of the bridge 704;

iii. such that the bridge 704 connects between the outer and inner alignment guides 702 708;

d) An elongator 705; wherein the elongator 705 is connected to the bridge 704, such that the elongator 705 projects upwards from the bridge 704;

e) A clip 710;

wherein the clip 710 can attach the clip-on device 700 to a standard golf putter by being clipped on to a hosel 706 of the standard golf putter; such that the position of the clip 710 on the elongator 705 and the hosel 706 can adjust the position and height of the outer alignment guide 702, the inner alignment guide 708, and the bridge 704; such that the inner and outer alignment guides are perpendicular to the face of the standard putting head, pointing in the putting target direction;

whereby a golf player can adjust proper putter alignment throughout an entire putting stroke, by ensuring that the inner and outer alignment guides 702 708 are pointed in the intended putting target direction.

In a related embodiment:

a) the outer alignment guide 702 can be connected to the outer end of the bridge 704, such that the outer alignment guide is substantially perpendicular to the bridge 704;

b) the inner alignment guide 708 can be connected to the inner end of the bridge 704, such that the inner alignment guide 708 is substantially perpendicular to the bridge 704;

In a related embodiment, the elongator 705, can project upwards from the bridge, substantially parallel to the hosel 706.

In an embodiment, the clip 710 can further comprise:

a) an outer clip arm 712;

b) an inner clip arm 714;

c) a clip fastener 716; which can be tightened such that the outer and inner clip arms 712 714 tighten around the hosel 706; to secure the clip 710 in place on the hosel 706, thereby securing the golf putter training clip-on device 700 in place on the standard golf putter.

Figure 8:
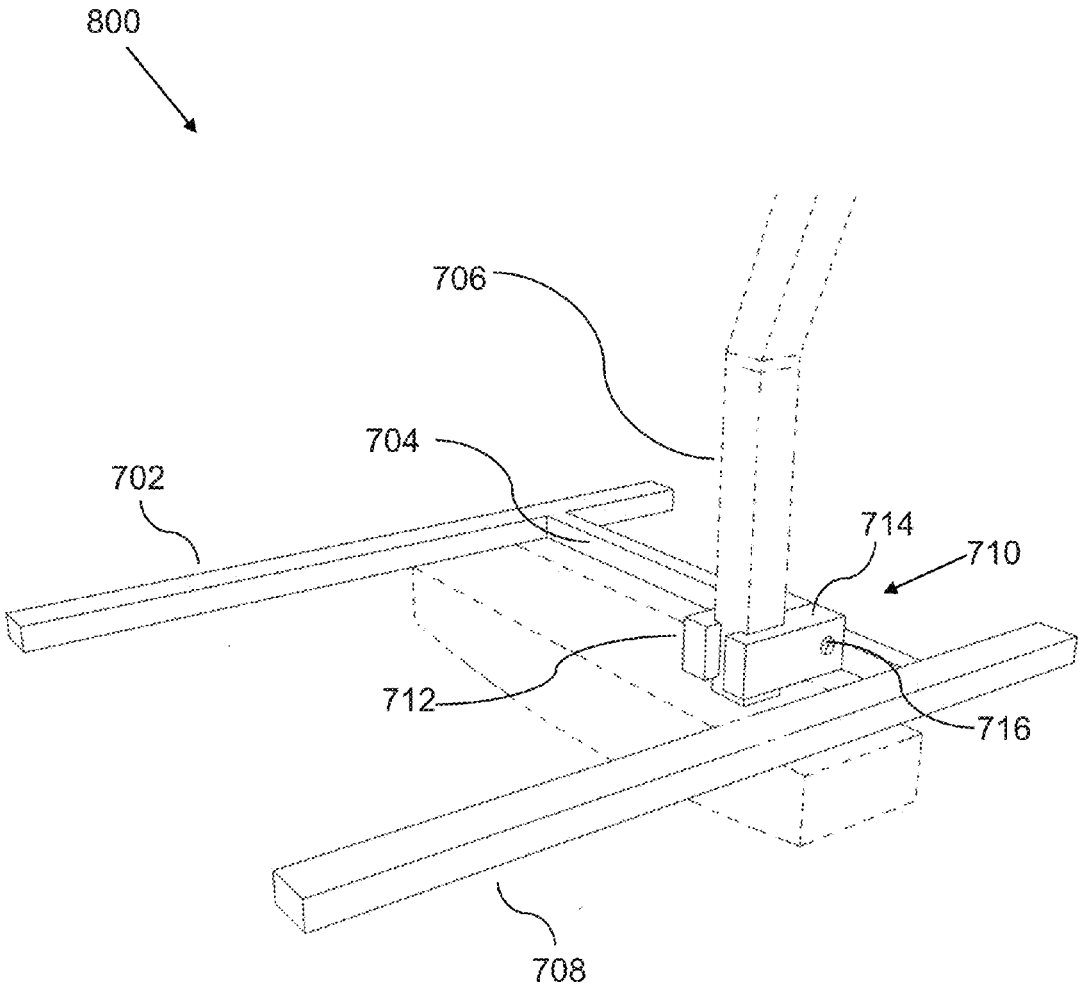
FIG. 8 depicts a perspective view of a golf putter training clip-on device without an elongator, according to an embodiment of the invention.

In a related alternative embodiment without an elongator, a golf putter training clip-on device 800, as illustrated in FIG. 8, can comprise:

a) An outer alignment guide 702;

b) An inner alignment guide 708;

c) A bridge 704; wherein the outer alignment guide 702 is connected to the outer end of the bridge 704, such that the outer alignment guide is perpendicular to the bridge 704;

the inner alignment guide 708 is connected to the inner end of the bridge 704, such that the inner alignment guide 708 is perpendicular to the bridge 704;

such that the bridge 704 connects between the outer and inner alignment guides 702 708;

d) A clip 710;

Wherein the clip 710 is connected to the bridge 704, and the clip 710 can attach the clip-on device 800 to a standard golf putter by being clipped on to a hosel 706 of the standard golf putter;

such that the position of the clip 710 on the hosel 706 can adjust the height of the outer alignment guide 702, the inner alignment guide 708, and the bridge 704; such that the inner and outer alignment guides are perpendicular to the face of the standard putting head, pointing in the putting target direction; whereby a golf player can adjust proper putter alignment throughout an entire putting stroke, by ensuring that the inner and outer alignment guides 708 702 are pointed in the intended putting target direction.

In various related embodiments, the clip 710 can employ a plurality of designs, all of which can rely on well-known mechanisms and designs. In a related example embodiment, the outer and inner clip arms 712 714 can be pivotally connected in the rear ends; such that a clasp can connect them on the front ends; whereby the clasp can be used to tighten the outer and inner clip arms 712 714 around the hosel 706.

Figure 10:
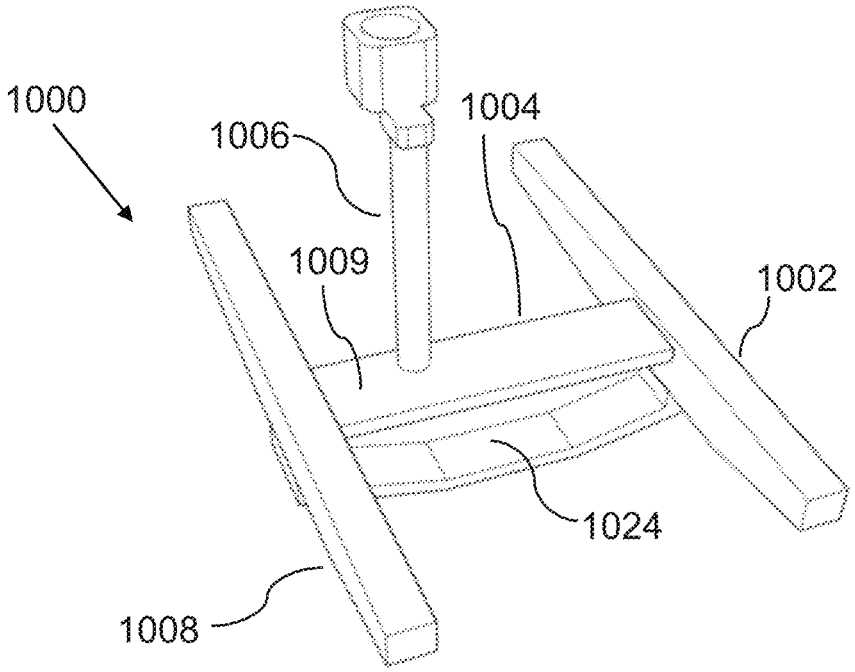
FIG. 10 depicts a perspective view of the adaptable training putter head, according to an embodiment of the invention.
Figure 11:
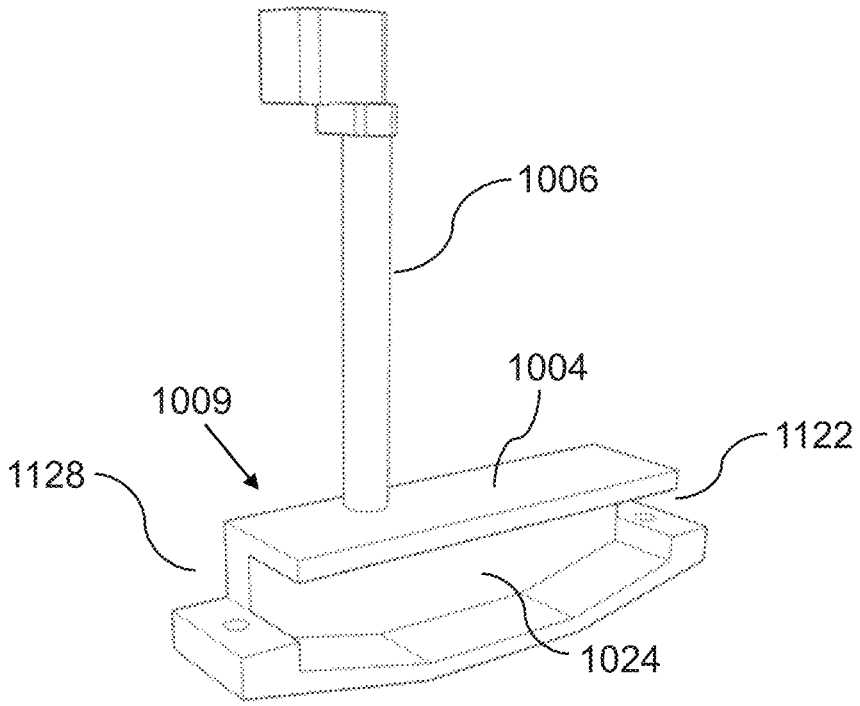
FIG. 11 depicts a perspective view of the adaptable training putter head, according to an embodiment of the invention.

In an embodiment, as shown in FIG. 10, an adaptable training putter head 1000 configured in non-conformant mode, can include:

a. a putting head 1009, as shown separately in FIG. 11, which further comprises:
   i. a cavity 1024; such that the cavity is open in a rear of the putting head 1009;
   ii. an outer cutout 1122, positioned in an outer end of the putting head 1009;
   iii. an inner cutout 1128, positioned in an inner end of the putting head 1009;
b. an outer alignment guide 1002, secured with a fastening mechanism, such as for example a screw; to the outer cutout 1122 of the putting head 1009, such that a direction of the outer alignment guide 1002 is in a putting target direction, perpendicular to a face of the putting head;
c. a hosel connector 1006, attached to the top of the putting head, such that a putting hosel with a handle can be connected to the hosel connector 1006; and
d. an inner alignment guide 1008, attached with fastening mechanism, such as for example a screw, to the inner cutout 1128 of the putting head 1009, such that a direction of the inner alignment guide is in the putting target direction, perpendicular to the face of the putting head;

such that the outer and inner alignment guides 1002 1008 protrude both forward and rearward from the putting head, whereby the adaptable training putter head 1000 is in a non-conforming configuration;

whereby a golf player can adjust proper putter alignment throughout an entire putting stroke, by ensuring that the inner and outer alignment guides 1008 1002 are pointed in the intended putting target direction, to visually confirm the direction of the intended put, when the golf player is addressing the putt and before the putting stroke is executed.

Figure 14:
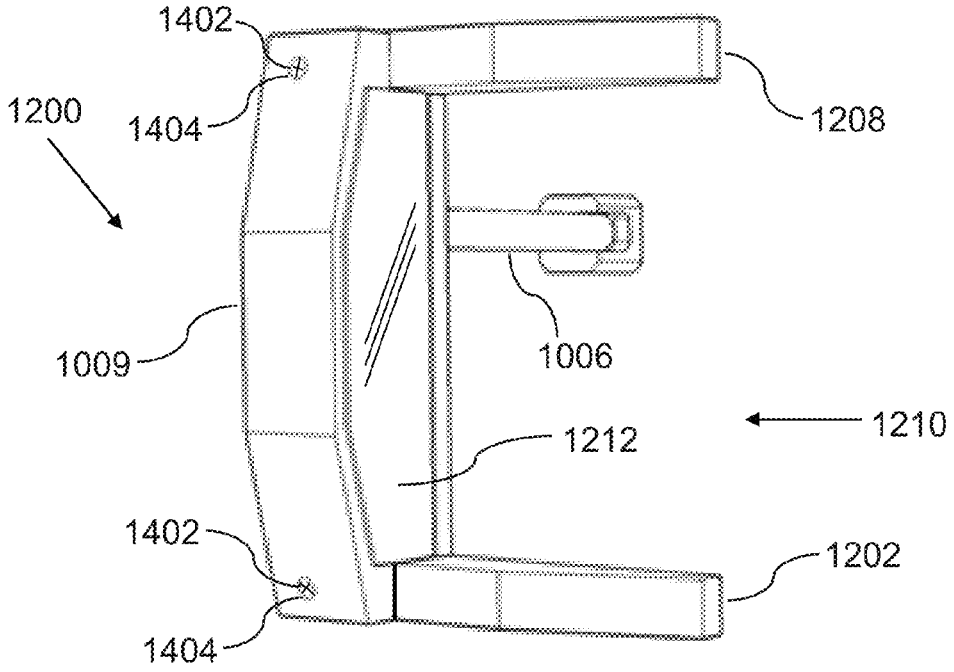
FIG. 14 depicts a bottom perspective view of the adaptable training putter head, according to the embodiment of the invention shown in FIG. 12.
Figure 15:
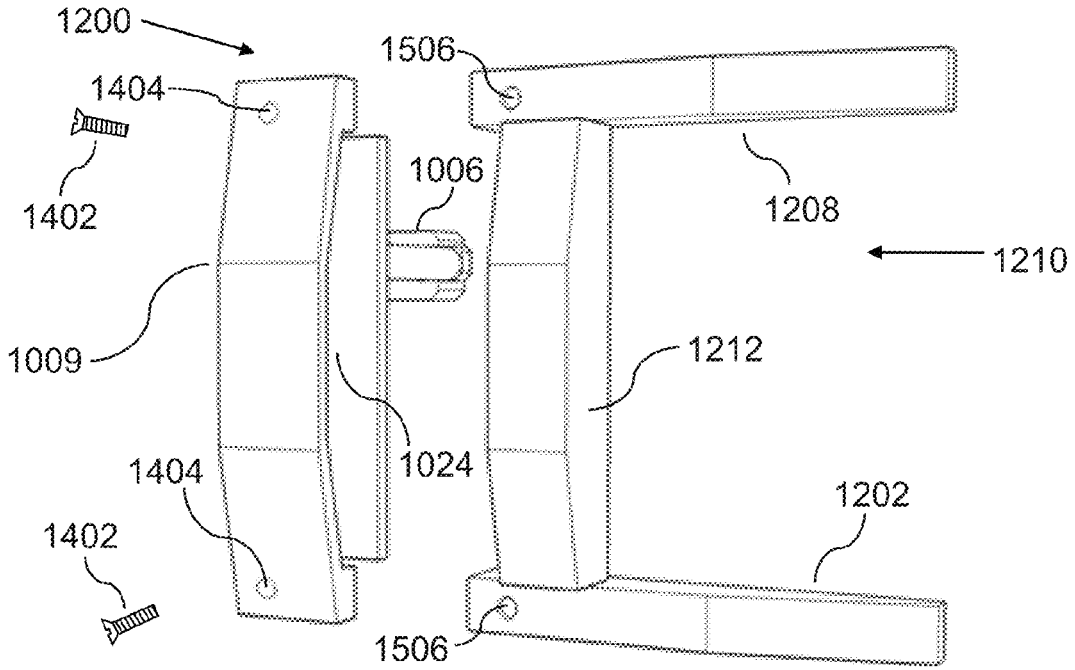
FIG. 15 depicts a bottom perspective view of the adaptable training putter head in a disassembled state, according to the embodiment of the invention shown in FIG. 12.

In a related embodiment, as illustrated in FIGS. 14 and 15, the alignment guides 1202 1208 can be attached with a fastening mechanism, here screws 1402, entering through bottom screw holes 1404, located in respectively inner and outer ends of the putting head 1009, and screwing into screw holes 1506 in the underside of the alignment guides 1202 1208.

Figure 12:
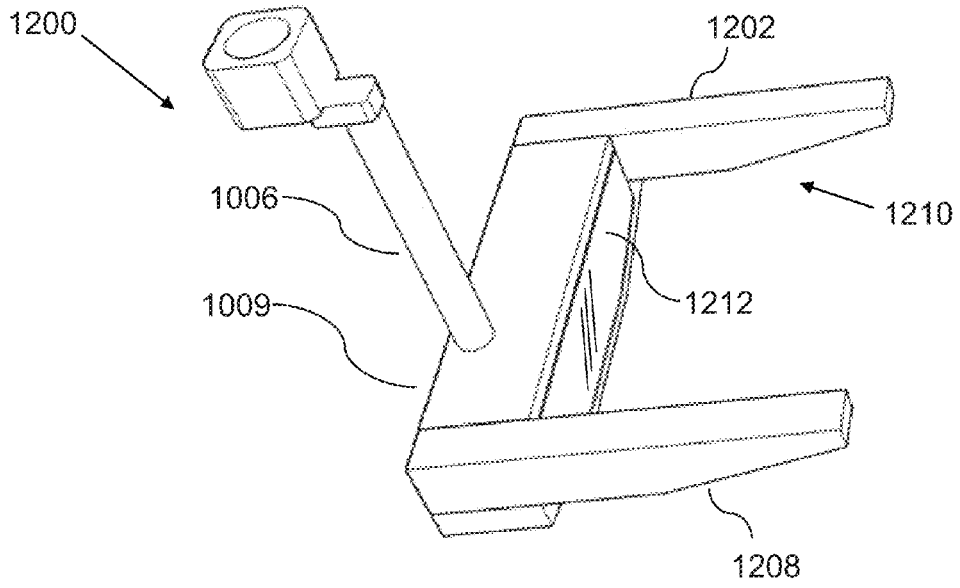
FIG. 12 depicts a perspective view of the adaptable training putter head, according to an embodiment of the invention.

In an embodiment, as shown in FIG. 12, an adaptable training putter head 1200 configured in conformant mode, can include:

a. a putting head 1009, as shown separately in FIG. 11, which further comprises:
   i. a cavity 1024 (not visible in FIG. 12), such that the cavity 1024 is open in a rear of the putting head 1009;
   ii. an outer cutout 1122;
   iii. an inner cutout 1128;
b. An alignment guide piece 1210, further including:
   i. an outer rear pointing alignment guide 1202, secured with a fastening mechanism, such as for example a screw; to the outer cutout 1122 of the putting head 1009;
   ii. an inner rear pointing alignment guide 1208, attached with fastening mechanism, such as for example a screw; to the standard putting head 1009, such that the inner alignment guide is mounted closer to the player;
   iii. a center insert bridge piece 1212, which is connected between the outer and inner rear pointing alignment guides 1202 1208, such that a front part of the center insert bridge piece 1212 fits inside the cavity 1024;
c. a hosel connector 1006, attached to the top of the putting head, such that a putting hosel with a handle can be connected to the hosel connector 1006; and such that the outer and inner rear pointing alignment guides 1202 1208 protrude only rearward from the putting head, whereby the adaptable training putter head 1200 is in a regulation conforming configuration;

whereby a golf player can adjust proper putter alignment throughout an entire putting stroke, by ensuring that the toe and heel mounted alignment guides 1002 1008 are pointed in the intended putting target direction, to visually confirm the direction of the intended put, when the golf player is addressing the putt and before the putting stroke is executed.

Figure 13:
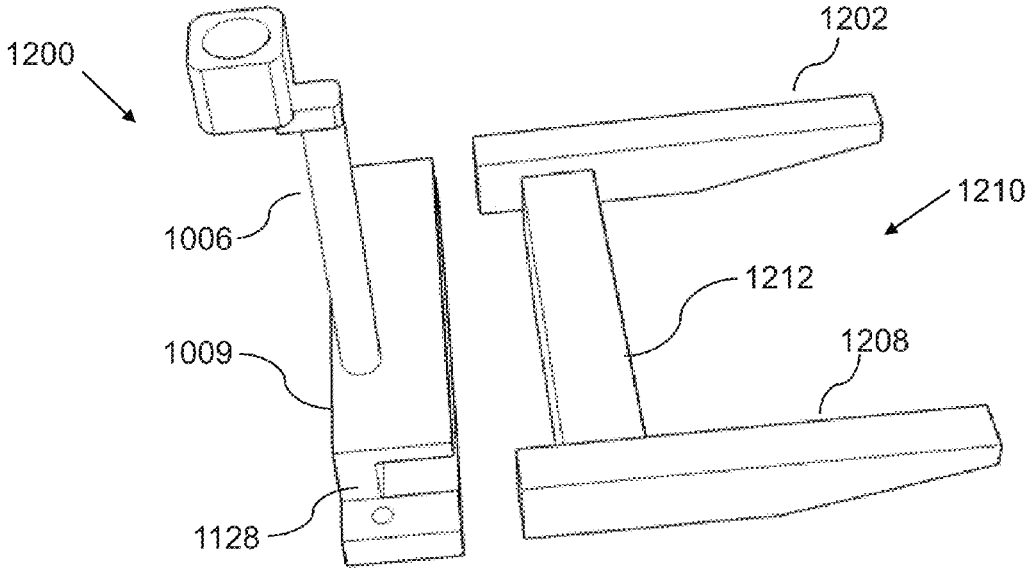
FIG. 13 depicts a perspective view of the adaptable training putter head in a disassembled state, according to the embodiment of the invention shown in FIG. 12.

In an embodiment, as shown in FIG. 13, an adaptable training putter head 1300 configured in conformant mode, can include:

a. a putting head 1009, as shown separately in FIG. 11, which further comprises:
   i. a cavity 1024 (mostly not visible in FIG. 13), such that the cavity 1024 is open in a rear of the putting head 1009;
   ii. an outer cutout 1122;
   iii. an inner cutout 1128;
b. An alignment guide piece 1210, further including:
   i. an outer rear pointing alignment guide 1202, secured with a fastening mechanism, such as for example a screw; to the outer cutout 1122 of the putting head 1009;
   ii. an inner rear pointing alignment guide 1208, attached with a fastening mechanism, such as for example a screw; to the standard putting head 1009, such that the inner alignment guide is mounted closer to the player;
   iii. a center insert bridge piece 1212, which is connected between the outer and inner rear pointing alignment guides 1202 1208, such that a front part of the center insert bridge piece 1212 fits inside the cavity 1024;
c. a hosel connector 1006, attached to the top of the putting head, such that a putting hosel with a handle can be connected to the hosel connector 1006; and such that the outer and inner rear pointing alignment guides 1202 1208 protrude only rearward from the putting head, whereby the adaptable training putter head 1200 is in a regulation conforming configuration;

whereby a golf player can adjust proper putter alignment throughout an entire putting stroke, by ensuring that the toe and heel mounted alignment guides 1002 1008 are pointed in the intended putting target direction, to visually confirm the direction of the intended put, when the golf player is addressing the putt and before the putting stroke is executed.

In a related embodiment, the alignment guide piece 1210 can weigh substantially the same as the two full-size alignment guides 1002 1008, whereby a training putter will weigh approximately the same whether it is being played in a conforming or non-conforming mode.

In various related embodiments, the alignment guide piece 1210 can be made in a plurality of size, shapes, color, and/or materials, whereby it can appeal to the aesthetic or technical desires of a golfer.

In a related embodiment, FIG. 14 shows a bottom view of the conforming adaptable training putter head 1200, wherein the rear pointing alignment guide insert 1210 is inserted into the putting head 1009, and the rear pointing alignment guides 1202 1208 are attached to the putting head 1009 with screws 1402 entering through bottom screw holes 1404, located in respectively inner and outer ends of the putting head 1009, and screwed into screw holes 1506, visible in FIG. 15, in the bottom of the alignment guides 1202 1208.

In a related embodiment, FIG. 15 shows a bottom view of the conforming adaptable training putter head 1200, wherein the rear pointing alignment guide insert 1210 has been separated from the putting head 1009

In related embodiments, the total weight of the regulation conformant adaptable training putter head 1200 and the regulation non-conformant adaptable training putter head 1000 can be configured to be substantially similar, such that a player can switch between configurations without adaptation of play. The weight can be adjusted by adjusting the length of the rear pointing alignment guides 1202 1208 and/or adjusting the weight and/or weight distribution of the center insert bridge piece 1212. This can include adapting the center insert bridge piece 1212, so it is for example inside the cavity 1024, flush with the rear opening of the cavity 1024, or protruding out to the rear of the cavity 1024. Adaptations of the center insert bridge piece 1212 can include different materials and color combinations, lettering, and other personalization features.

In related embodiments, front ends of the rear pointing alignment guides 1202 1208 can be flush with a front face of the putting head 1009

In various related embodiments, different parts can be fitted to a putting head 1009, including outer and inner alignment guides 1002 1008, outer and inner rear pointing alignment guides 1202 1208, or a rear pointing alignment guide piece 1210, such that the putting head 1009 can be configured as an adaptable putting head in various conforming or non-conforming configurations.

Here has thus been described a multitude of embodiments of the adaptable training putter head, which can be employed in numerous modes of usage. Particularly, embodiments of the adaptable training putter head can function as a training putter, whereby it can be used as a method for improving accuracy during the putting phase of the golf game. In addition, embodiments of the adaptable training putter head can function as a conventional putter for both non-regulation conforming recreational and regulation conforming competitive usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. An adaptable training putter head for use in a training putter, comprising:

a) a putting head, further comprising:

i. a cavity; such that the cavity is open in a rear of the putting head; and b) an alignment guide piece, further comprising:

an outer alignment guide, secured with a fastening mechanism to the putting head, such that a direction of the outer alignment guide is in a putting target direction, perpendicular to a face of the putting head;

an inner alignment guide, attached with a fastening mechanism, to the putting head, such that the inner alignment guide is mounted closer to the player than the outer alignment guide, such that a direction of the inner alignment guide is in the putting target direction, perpendicular to the face of the putting head; and a center insert bridge piece, which is connected between the outer and inner alignment guides, such that a front part of the center insert bridge piece fits inside the cavity;

whereby a golf player adjusts proper putter alignment throughout an entire putting stroke, by ensuring that the inner and outer alignment guides are pointed in the intended putting target direction.

2. The adaptable training putter head of claim 1, wherein the putting head, further comprises:

a) an outer cutout, in an outer end of the putting head, such that the outer alignment guide is secured with a fastening mechanism to the outer cutout; and b) an inner cutout, in an inner end of the putting head, such that the inner alignment guide is secured with a fastening mechanism to the inner cutout.

3. The adaptable training putter head of claim 1, wherein the outer and inner alignment guides protrude both forward and rearward from the putting head.

4. The adaptable training putter head of claim 1, wherein the outer and inner rear pointing alignment guides protrude only rearward from the putting head.

5. The adaptable training putter head of claim 1, further comprising:

a hosel connector, attached to a top of the putting head, whereby a putting hosel with a handle is connected to the hosel connector.

6. The adaptable training putter head of claim 1, wherein the outer alignment guide and the inner alignment guide are detachable.

7. The adaptable training putter head of claim 1, wherein the outer and inner alignment guides each further comprise an upper body and a lower body, such that the lower body is covered by the upper body.

8. The adaptable training putter head of claim 1, wherein the outer and inner alignment guides each further comprise an alignment guide cavity, whereby a weight of the adaptable training putter head is reduced and balance of the adaptable golf putter head is improved.

9. The adaptable training putter head of claim 1, wherein the outer and inner alignment guides each further comprise at least one weight cavity, wherein optionally an alignment guide weight is inserted, whereby a weight of the adaptable training putter head is adjusted and balance of the adaptable golf putter head is improved.

10. The adaptable training putter head of claim 1, wherein the outer and inner alignment guides are top mounted.

11. The adaptable training putter head of claim 1, wherein the outer and inner alignment guides are side mounted.

* * * * *